US006237341B1

(12) United States Patent
Koike et al.

(10) Patent No.: US 6,237,341 B1
(45) Date of Patent: May 29, 2001

(54) BOILER SCALE COLLECTING DEVICE BEFORE STEAM TURBINE

(75) Inventors: Masami Koike; Yoshitaka Uchida; Akihiro Sato; Eisaku Nakashima, all of Fukuoka; Toshihiro Sato, Nagasaki; Keishi Suga, Nagasaki; Masaharu Takada, Nagasaki; Mutsuo Kuragasaki, Nagasaki, all of (JP)

(73) Assignees: Kyushu Electric Power Company, Fukuoka; Mitsubishi Heavy Industries, Ltd., Tokyo, both of (JP)

( * ) Notice: Subject to any disclaimer, the term of this patent is extended or adjusted under 35 U.S.C. 154(b) by 0 days.

(21) Appl. No.: 09/354,564

(22) Filed: Jul. 16, 1999

(30) Foreign Application Priority Data

Mar. 9, 1999 (JP) ..... 11-062405

(51) Int. Cl.[7] ..... F01K 13/02
(52) U.S. Cl. ..... 60/656; 60/657; 60/670
(58) Field of Search ..... 60/656, 657, 670

(56) References Cited

U.S. PATENT DOCUMENTS 5,111,663 * 5/1992 Brandon ..... 60/657 X
5,305,607 * 4/1994 Bonham, Jr. ..... 60/657 X

FOREIGN PATENT DOCUMENTS 58-202312 11/1983 (JP) .
60-169100 9/1985 (JP) .
61-22517 2/1986 (JP) .
6-63336 3/1994 (JP) .
6-320055 11/1994 (JP) .
8-28208 1/1996 (JP) .
9-158706 6/1997 (JP) .
2777061 5/1998 (JP) .

* cited by examiner

*Primary Examiner*—Hoang Nguyen
(74) *Attorney, Agent, or Firm*—Wenderoth, Lind & Ponack, L.L.P.

(57) ABSTRACT

A boiler scale collecting device enables collecting and recovery of most boiler scale particulates (p) in a steam flow line (f) in a steam pipe (02) extending from a power generation steam boiler to an inlet (01') of a power generation steam turbine (01). The steam pipe (02), of constant inner diameter (d), extends from the boiler side to the inlet (01') of the steam turbine (01), and turns at direction turning portion (e) from a vertical steam pipe (02') to a lateral steam pipe (02") near the inlet (01") of the steam turbine (01). The vertical steam pipe (02') is elongated beyond the direction turning portion (e) to form an elongated portion **(02'*a*) having a lower end (02"*a*). The direction turning portion (e), including the vertical steam pipe (02') and the lateral steam pipe (02"), and the elongated portion (02'*a*)** are made in an integral unit of forged steel.

9 Claims, 9 Drawing Sheets

4
10
11
12
13
14
15
16
17
18
19
3
5
7
8
9
30
V
S
IV
IV
d
y
L>2d
R1
R2
R3
R4
θ1
θ2
θ3
γ

15
19
d/3

BOILER SCALE COLLECTING DEVICE BEFORE STEAM TURBINE

BACKGROUND OF THE INVENTION

1. Field of the Invention

The present invention relates to a boiler scale collecting device for collecting solid particulates (boiler scales) in a main steam pipe extending from a boiler to a power generation steam turbine in a power plant for preventing erosion of a steam turbine blade.

2. Description of the Prior Art

In a thermal power plant or the like, steam oxide scales are often generated on boiler tube materials, which peel due to quick starts or sudden load changes and cause erosion damage of a steam turbine blade with the peeled scales. Thus, countermeasures for preventing such erosion damage have been long desired. As such the countermeasures, the following have been practiced:

1. As a countermeasure on the steam turbine side, the blade is hardened for enhancement of erosion resistance. But this has only a short life and is expensive and allopathic. Thus there is a need to replace the blade at every periodic repair, which results in a largely elongated work period for the blade surface hardening treatment. Also, if there is a large amount of scale carried, damage may arise within a short period, requiring needs a severe maintenance control. Further, the blade surface hardening treatment cannot be measured on site, which makes life evaluation thereof difficult.

2. As a countermeasure on the boiler side, there is used a high class of material or boiler tube material on which boiler steam oxide scales are hardly generated, or accumulated scales are removed by cutting a boiler tube. But employment of this measure is actually difficult because of the cost and work period, and because of there being no fundamental countermeasure. Also, chemical cleaning is used for removing scales on an inner surface of a main steam pipe using chemicals, but this is expensive, its efficiency is low and there is uncertainty in the effect when this cleaning is used alone. Moreover, this cleaning is also allopathic and requires periodic performance.

3. A geothermal steam pipe extending to a steam turbine has a bent portion where a horizontal portion is turned to a vertical portion near an inlet of the steam turbine. The horizontal portion is elongated to form an elongated portion and a scale collecting mesh screen is provided in the elongated portion via a bolt type flange coupling (Japanese laid-open utility model application No. Sho 61-22517). But has this device the following problem:

(1) Geothermal steam to be used is of a low steam pressure of 10 kg/cm$^2$ or so in the steam pipe, and the device is constructed such that the scale collecting portion is uncoupled for discharge of the collected scales. Hence the device is not applicable to a high temperature and high pressure steam pipe in a thermal power plant boiler in terms of strength and sealing ability.

(2) The scale collecting portion has a grid screen in front thereof on which the scales impinge, with resultant re-scattering thereof.

(3) The scale collecting portion is disposed vertically, which makes the steam density high when the steam is of high temperature and high pressure as compared with the geothermal steam with a resultant small density difference between the steam and a the scales, and a scale collecting performance, if the scale collecting is to be done only by inertia force, is reduced.

4. A scale collector has a guide plate and a magnet in a horizontal end portion of a steam pipe (Japanese laid-open patent application No. Sho 60-169100). But this device has the following problem:

(1) The scales are prevented by the guide plate from flowing into the scale collecting portion by the inertia force with resultant re-scattering thereof.

(2) The guide plate and the magnet are disposed in the steam pipe in which the steam flows at a high velocity of 50 m/s or more, with a resultant problem of resonance, which is to be avoided.

(3) The device is constructed such that a flat plate flange coupling having the magnet is uncoupled for discharge of the collected scales, hence the device is not applicable to a high temperature and high pressure use in terms of strength and sealing ability.

5. As steam pressure in a steam pipe extending from a boiler to a steam turbine inlet is as high as 40 to 245 kg/cm$^2$, while a side face of a vertical portion of the steam pipe and a lateral portion thereof may be connected together by welding, it requires skill completely uniform welding is not always possible and the strength thereof may deteriorated. Hence there is a problem in the practical use.

Also, when the steam turns from the vertical portion to the lateral portion, while boiler scale particulates want to go down toward a scale collecting portion due to inertia force in the vertical direction and gravity (G), there are upward flows, swirling flows and the like caused by the turning of the steam in the scale collecting portion by which the boiler scale particulates scatter and are entrained toward the lateral portion, resulting in a possibility of flowing into the steam turbine.

Entrainment of the scales into the steam turning flow is decided by the quantity and particle sizes of the boiler scale particulates in the steam and a depth of the scale collecting portion. As the result of actual state simulation tests, however, it has been found that if the operation is within a predetermined legal periodical inspection period (usually two years), the entrainment of the scales may be prevented only by the depth of the scale collecting portion being set to a predetermined value or more relative to a steam pipe inner diameter, regardless of the quantity and particle sizes of the boiler scale particulates.

6. Japanese laid-open patent application No. Hei 8-28208 discloses a steam turbine blade erosion preventing device for preventing the blade from being eroded by solid particulates. The device is constructed such that a main steam pipe extending from a boiler side to a steam turbine inlet is turned in direction near the steam turbine inlet, a scale collecting portion is provided right below the direction turning portion of the main steam pipe and a scale discharge valve is provided at a lower end of the scale collecting portion. In this device, however, there arise swirling flows of the steam in a pocket according to its depth to cause re-scattering of the collected scales. Hence by the re-scattering of the scales and the swirling flows, the pocket interior may be eroded.

As one example of such a device in the prior art, there is a scale collecting device as shown in FIG. 12. A steam pipe has a bent portion so that a steam main flow 004 may turn quickly from a vertical downward pipe 001 to a horizontal branch pipe 002, a tubular pocket 003 for collecting scales is provided at a lower portion of the vertical downward pipe 001, whereby scales 005 in the steam are separated by the inertia force and the centrifugal force caused by the quick turning of the steam main flow 004.

In the scale collecting device having the steam piping shown in FIG. 12, turbulence of the steam main flow 004 flowing from the vertical downward pipe 001 to the horizontal branch pipe 002 arises, whereby unsteady flow 004' in the tubular pocket 003 swirls around a central axis of the tubular pocket 003 so that the scales 005 which have been once separated move violently in the tubular pocket 003 to again mix into the main flow. This not only results in a lowering of the collection efficiency, but also is a cause of erosion of a bottom portion of the tubular pocket 003, because the scales 005 impinge thereon intermittently.

SUMMARY OF THE INVENTION

In view of the problems in the prior art, it is an object of the present invention to provide a boiler scale particulate collecting device of high safety comprising a boiler scale collecting portion provided in a high pressure steam pipe extending from a boiler to an inlet of a power generation steam turbine for collecting boiler scale particulates for a predetermined period and preventing collected scales from re-scattering and being entrained toward the steam turbine side.

In order to attain the object, the present invention provides a boiler scale collecting device before a steam turbine is constructed such that a steam pipe of a constant inner diameter extending from a boiler side to a steam turbine inlet has a direction turning portion where a vertical steam pipe is turned to a lateral steam pipe near the steam turbine inlet. The vertical steam pipe is elongated downwardly from the direction turning portion to form an elongated portion. A scale collecting portion is formed by the elongated portion and a scale discharge valve provided to a lower end of the elongated portion via a hopper. The direction turning portion, including the vertical steam pipe and lateral steam pipe, and the elongated portion are made in an integral unit of forged steel.

In the above-mentioned boiler scale collecting device, a length of the elongated portion is preferably about four times or more of the inner diameter of the steam pipe.

According to the boiler scale collecting device of the present invention constructed as mentioned above, boiler scales flowing from a steam boiler together with steam are caught to be collected in the scale collecting portion disposed below the direction turning portion regardless of the particle sizes of the scales. Further, as the direction turning portion and the elongated portion are made in an integral unit of forged steel, the boiler scale particulates can be collected safely without problems in the sealing ability for a high pressure steam.

The boiler scale collecting device of the present invention is constructed such that the lateral steam pipe which is turned from the vertical steam pipe is further turned vertically downward so that the scale collecting portion is formed in plural stages. A boiler scale collecting device having a higher collection efficiency can thus be obtained.

The boiler scale collecting device of the present invention is constructed such that the direction turning portion, including the vertical steam pipe and lateral steam pipe, is connected with a vertical steam pipe and a lateral steam pipe. The elongated portion is connected at its lower end with the hopper and all connection portions so connected are formed by welding so that all these steam pipes and the hopper are made in an integral unit. The boiler scale collecting device is thus manufactured easily and has a high pressure resistance and safety.

Also, in order to attain the object, the present invention provides a boiler scale collecting device constructed such that steam piping is formed so that steam main flow turns quickly at a horizontal branch portion where a vertical downward pipe is turned to a horizontal branch pipe. The vertical downward pipe is elongated beyond the horizontal branch portion to form a tubular pocket, and a baffle plate is provided in the tubular pocket in parallel with a tubular axis thereof.

According to the boiler scale collecting device of the present invention constructed as mentioned above, there is provided the baffle plate for partitioning the interior of the tubular pocket along the vertical tubular axis direction from the pocket bottom portion. No swirling flow is thus caused in the tubular pocket around the central axis thereof, hence the collected scales do not move violently to mix into the steam main flow again and as their flow velocity becomes slow in the tubular pocket, erosion of the pocket bottom portion can be prevented.

Also, in order to attain the object, the present invention provides a boiler scale collecting device before a steam turbine constructed such that steam main flow flowing in steam piping for leading steam from a boiler to a turbine is caused to pass through a bent passage or a branch/turn passage so that scale mixed in the steam may be separated. The steam piping is formed so that the steam main flow turns quickly at a horizontal branch portion where a vertical downward pipe is turned to a horizontal branch pipe. The vertical downward pipe is elongated beyond the horizontal branch portion to form a tubular pocket. The tubular pocket constitutes a scale accumulating portion and the scale accumulating portion is connected to a scale collector as well as being provided at its proximal end and distal end with opening/closing valves, respectively.

As mentioned above, the scale accumulating portion is provided at its proximal and distal ends with the opening/closing valves. Thus, by operating these opening/closing valves appropriately, the collected scales are accumulated in the scale accumulating portion and the accumulated scales in the scale accumulating portion are recovered into the scale collector while the plant equipment is in operation without being stopped.

Also, in order to attain the object, the present invention provides a boiler scale collecting device constructed as follows. That is, there are provided, in a mid portion of a substantially horizontally disposed steam piping, a first bent pipe of a curvature radius $R_1$ and a bending angle $\theta_1$, a downward straight pipe extending from the first bent pipe, a second bent pipe of a curvature radius $R_2$ and a bending angle $\theta_2$ extending from the downward straight pipe and a horizontal pipe extending from the second bent pipe and disposed below the substantially horizontally disposed steam piping. The horizontal pipe has an upward branch pipe of an upward angle $\gamma$ and a straight pipe portion. The upward branch pipe connects to the substantially horizontally disposed steam piping via a third bent pipe of a curvature radius $R_3$ and a bending angle $\theta_3$. The straight pipe portion connects to a fourth bent pipe of a curvature radius $R_4$ and a bending angle of 90°, and the fourth bent pipe is elongated downward vertically to form a tubular pocket, where an inner diameter of the steam piping is d, the curvature radii $R_1$, $R_2$, $R_3$ and $R_4$, respectively, are larger than 1.5 d and smaller than 2.5 d ($1.5\,d<R_1, R_2, R_3, R_4<2.5\,d$). The bending angles $\theta_1$, $\theta_2$ and $\theta_3$, respectively, are larger than 60° and smaller than 90° ($60°<\theta_1, \theta_2, \theta_3<90°$) and $\gamma$ equals 60° ($\gamma=60°$).

In the above-mentioned scale collecting device, between the two horizontal pipes disposed with a space in the vertical direction, the first bent pipe, the downward straight pipe and the second bent pipe are provided sequentially, and the second bent pipe turns quickly to connect to the second horizontal pipe. The scales mixed in the steam main flow are thereby biased toward the outer peripheral side of the bent pipe to then enter the second horizontal pipe. As this horizontal pipe connects to the tubular pocket, whose distal end is closed, via the straight pipe portion and the fourth bent pipe having the bending angle of 90°, there is little flow of the steam there and the steam main flow turns quickly to flow through the upward branch pipe. At this time, the scales still remaining in the steam main flow proceed in the direction of the tubular pocket by the inertia force.

As the distance between the scale collecting device and the turbine becomes longer, the scales are produced more, but the scale collecting devices mentioned above may be disposed near the turbine. Hence steam having fewer scales can be led into the turbine.

In the device having bent passages or branch/turn passages in the steam main flow for separating and collecting the mixed scales, it is important to balance the collection efficiency and the pressure loss.

FIG. 9 shows a relation between the bending angle θ and the pressure loss $P_L$ at the time when the curvature radius of the bent pipe is set to 1.5 d to 2.5 d, where d is the inner diameter of the steam pipe. From this it is found that the design allowable value of the pressure loss is obtained when the bending angle is 90° or less.

Also, FIG. 10 shows a relation between the bending angle θ and the scale collection efficiency ηs, and while it is shown that as the steam flow turns quickly or largely, the efficiency becomes higher, the minimum allowable value is obtained with the bending angle θ of 60°.

From FIGS. 9 and 10, where the inner diameter of the steam pipe in which steam flows is d and the curvature radius R of the bent pipe which constitutes the scale collecting device is set to $1.5\ d<R<2.5\ d$, it is found that the bending angle θ is to be set to $60°<\theta<90°$ in order to set the pressure loss $P_L$ and the scale collection efficiency ηs in a practical range.

In the present scale collecting device, if there is provided, in an upper portion of an inner wall of the horizontal pipe, immediately before the upward branch pipe, a projection projecting from a top portion of the horizontal pipe toward a central portion thereof, then the steam main flow flowing from the downward straight pipe impinges on this projection and the scales contained in the steam main pipe flowing toward the upward branch pipe can be efficiently separated.

Also, in the present scale collecting device, there is preferably provided a partition plate in a pipe passage extending from a downstream side of a branch portion of the upward branch pipe to a mid portion of the fourth bent pipe. That is, in the present scale collecting device, while the scales separated by the second bent pipe flow on a lower side in the horizontal pipe, they may fly up or scatter upward again near an inlet of the upward branch pipe. Such flying up or scattering upward is suppressed by the partition plate and the scales are led into the pocket, preferably.

Further, in the present scale collecting device, the scale accumulating portion may be provided at its proximal and distal ends with the opening/closing valves, and the tubular pocket may constitute the scale accumulating portion. By operating these opening/closing valves appropriately, the collected scales are accumulated in the scale accumulating portion. The accumulated scales in the scale accumulating portion are preferably covered, while the plant equipment is in operation without being stopped.

DESCRIPTION OF THE PREFERRED EMBODIMENTS

Herebelow, description will be made concretely on scale collecting devices of embodiments according to the present invention with reference to FIGS. 1 to 11.

First Embodiment

Figure 2:
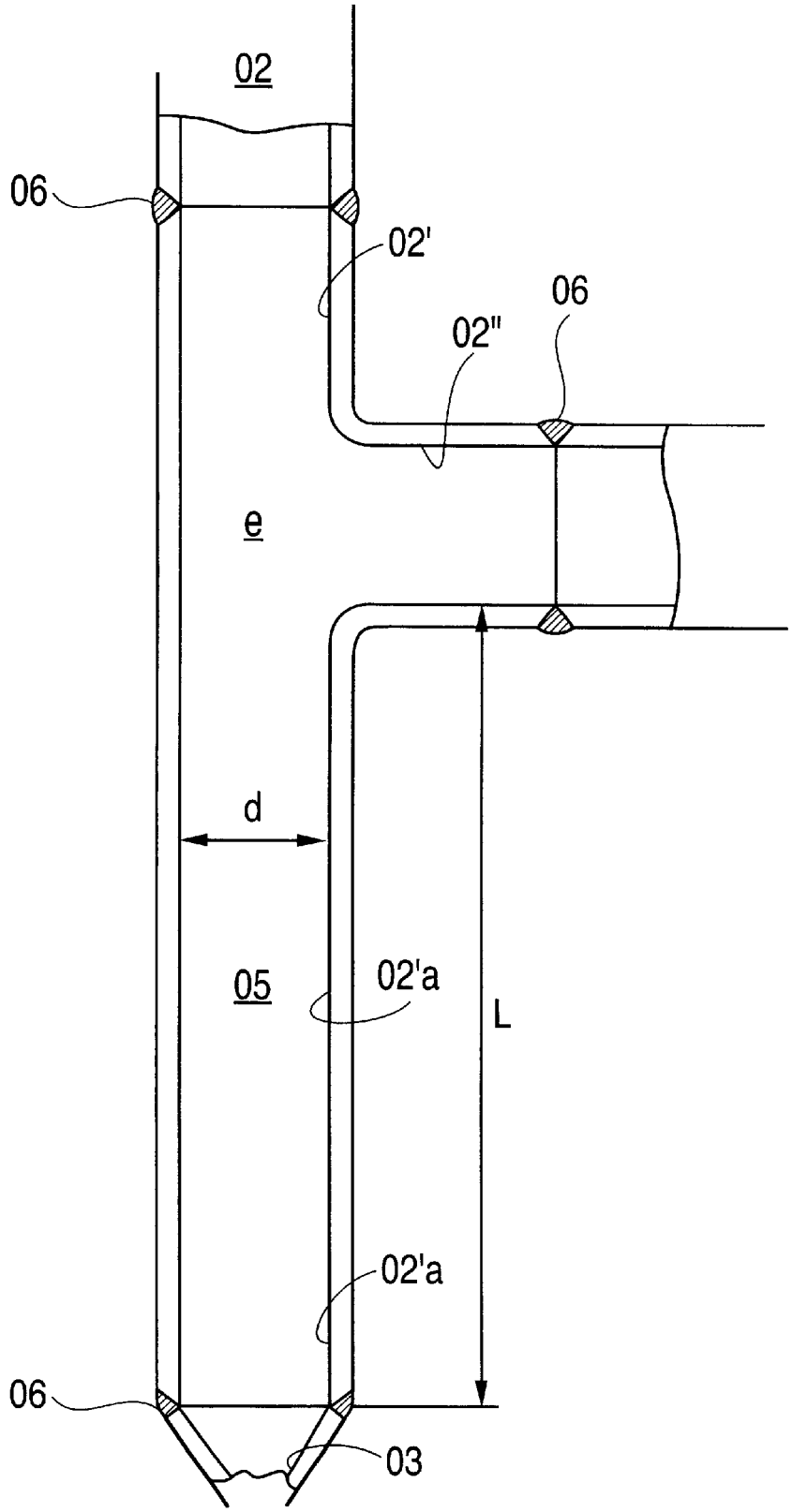
FIG. 2 is a partial longitudinal cross sectional side view of the device of FIG. 1.
Figure 3:
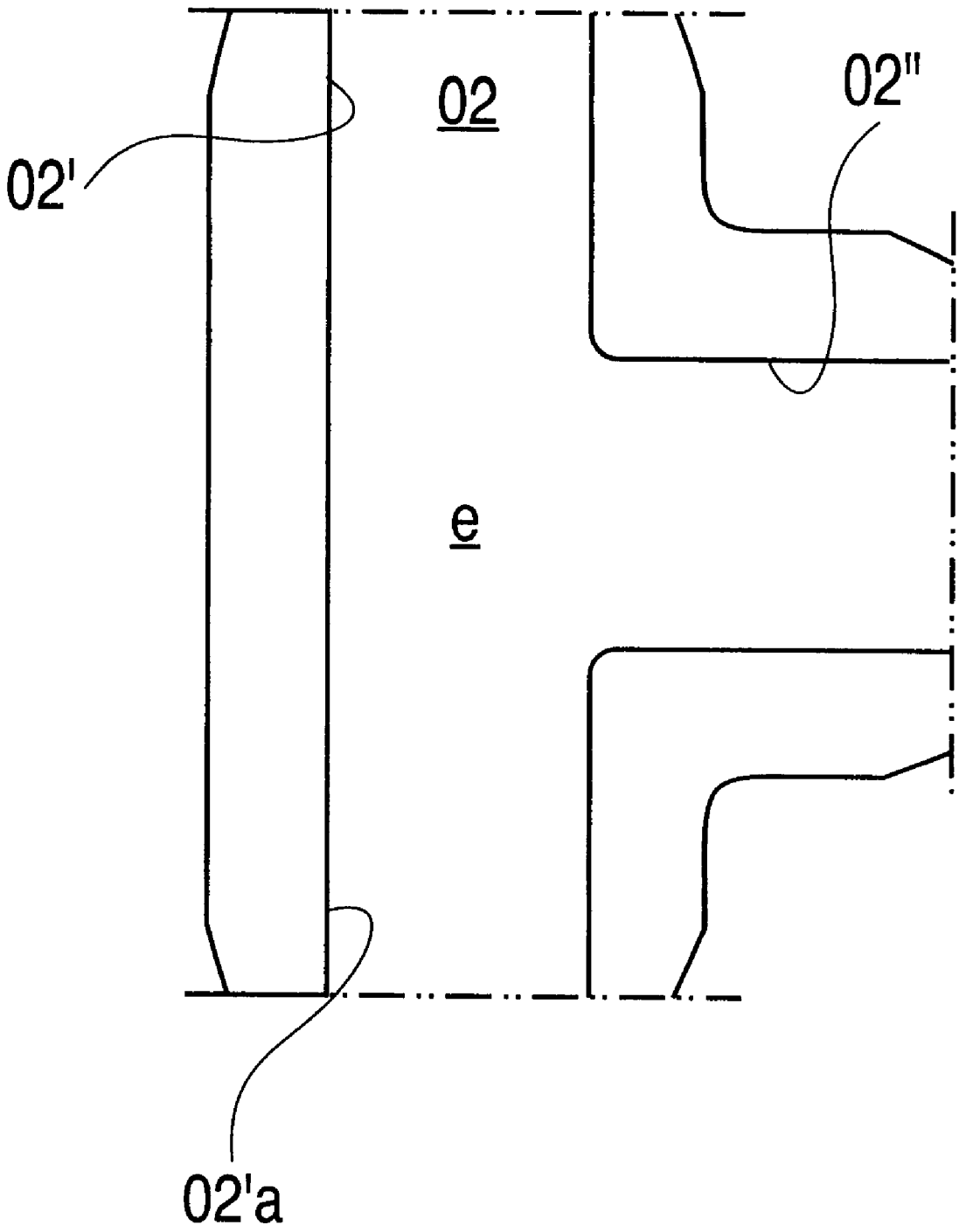
FIG. 3 is an enlarged cross sectional view of a communicating portion of a vertical steam pipe and a lateral steam pipe of the device of FIG. 1.

A boiler scale collecting device of a first embodiment will be described with reference to FIGS. 1 to 3. A flow line f is formed by a main steam pipe of a constant inner diameter d extending from a power generation boiler side to an inlet 01' of a power generation steam turbine 01. A vertical steam pipe 02' is disposed near the inlet 01' of the steam turbine 01.

A lateral steam pipe 02" of the same inner diameter d is provided to connect to a side mid portion of the vertical steam pipe 02' so that the flow line f may be turned at e to the lateral direction from the vertical direction. The vertical steam pipe 02' is elongated downward vertically from this direction turning portion e. An elongated portion 02'*a* so extended has at its lower end a conical hopper 03, whose inner diameter is gradually reduced, connected by welding 06. A scale discharge valve 04 is provided to a lower end opening portion of the conical hopper 03, and thus a scale collecting portion 05 is formed below the direction turning portion e.

The direction turning portion e, including the vertical steam pipe 02' and the lateral steam pipe 02", and the elongated portion 02'*a* are made in an integral unit of forged steel. A steel vertical steam pipe 02' is connected to an upper end of the forged vertical steam pipe 02' by welding 06. A steel lateral steam pipe is connected to an end of the forged lateral steam pipe 02" by welding 06, and the steel lateral steam pipe is connected to the inlet 01' of the steam turbine 01 via an opening/closing valve 07. Also, a lower end 02"*a* of the elongated portion 02'*a* and the conical hopper 03, which is made of steel, are connected together by welding 06. FIG. 3 shows that at least the vertical steam pipe 02' and the lateral steam pipe 02" connected to the side mid portion thereof in T-shape are made in an integral unit of forged steel.

The inner diameter d of the vertical steam pipe 02' and the lateral steam pipe 02" are the same. Where a length (depth) from a lower boundary of the direction turning portion e, that is, an inner circumferential bottom level of the lateral steam pipe 02", to the lower end 02"*a* of the elongated portion 02'*a*, is L, L is set to about four times or more of the inner diameter d (L>about 4d). Thus, by a combined force of the vertical inertia force and the gravity (G), the boiler scale particulates p can be mostly collected in the scale collecting portion 05, regardless of the particle sizes of the boiler scale particulates p and the quantity change of the flowing boiler scale particulates p.

As the result of actual state simulation tests, it has been recognized that when the opening/closing valve 07 is closed at the legal periodical inspection period (every two years) of the steam boiler, the scale particulates p are prevented from being carried to the direction turning portion e by swirling flows and re-scattering in the elongated portion 02'*a*. Also the direction turning portion e and the elongated portion 02'*a* are prevented from being eroded by the scale particulates p carried by the swirling flows and re-scattering. Accordingly, the discharge valve 04 is opened within the inspection period so that the collected boiler scale particulates p' are discharged.

It is possible that the lateral steam pipe 02" extending laterally from the direction turning portion e is again turned down vertically so as to form another vertical steam pipe 02' and another scale collecting portion 05 therebelow, as in the above-mentioned arrangement, and further, that the same is repeated to form a plurality of such stages (not shown).

Figure 1:
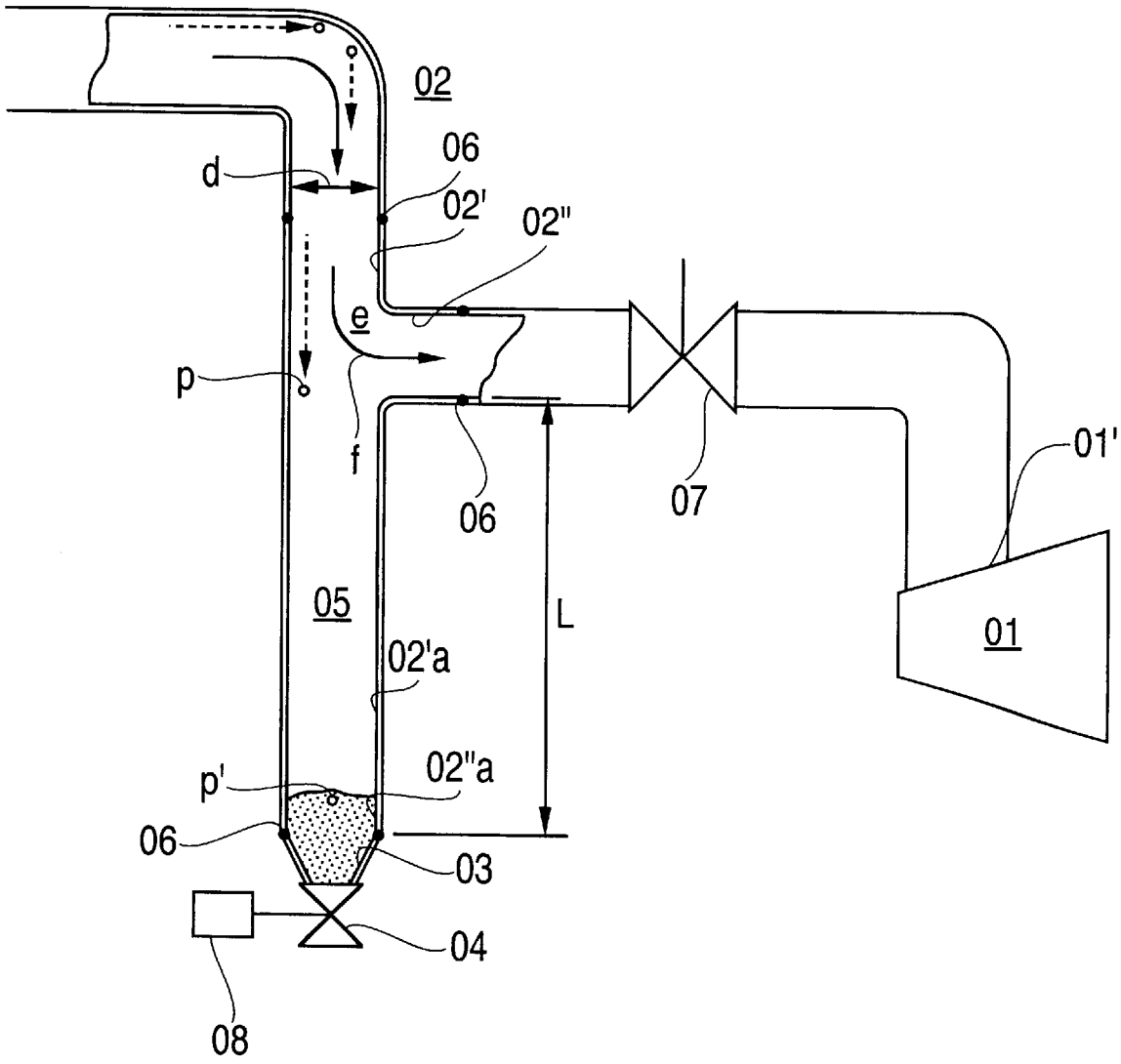
FIG. 1 is a partially cut away explanatory side view showing a boiler scale collecting device before a steam turbine of a first embodiment according to the present invention.

It is to be noted that, in FIG. 1, numeral 08 designates an electric motor for driving the discharge valve 04 and a letter p' designates collected boiler scale particulates.

Second Embodiment

Figure 12:
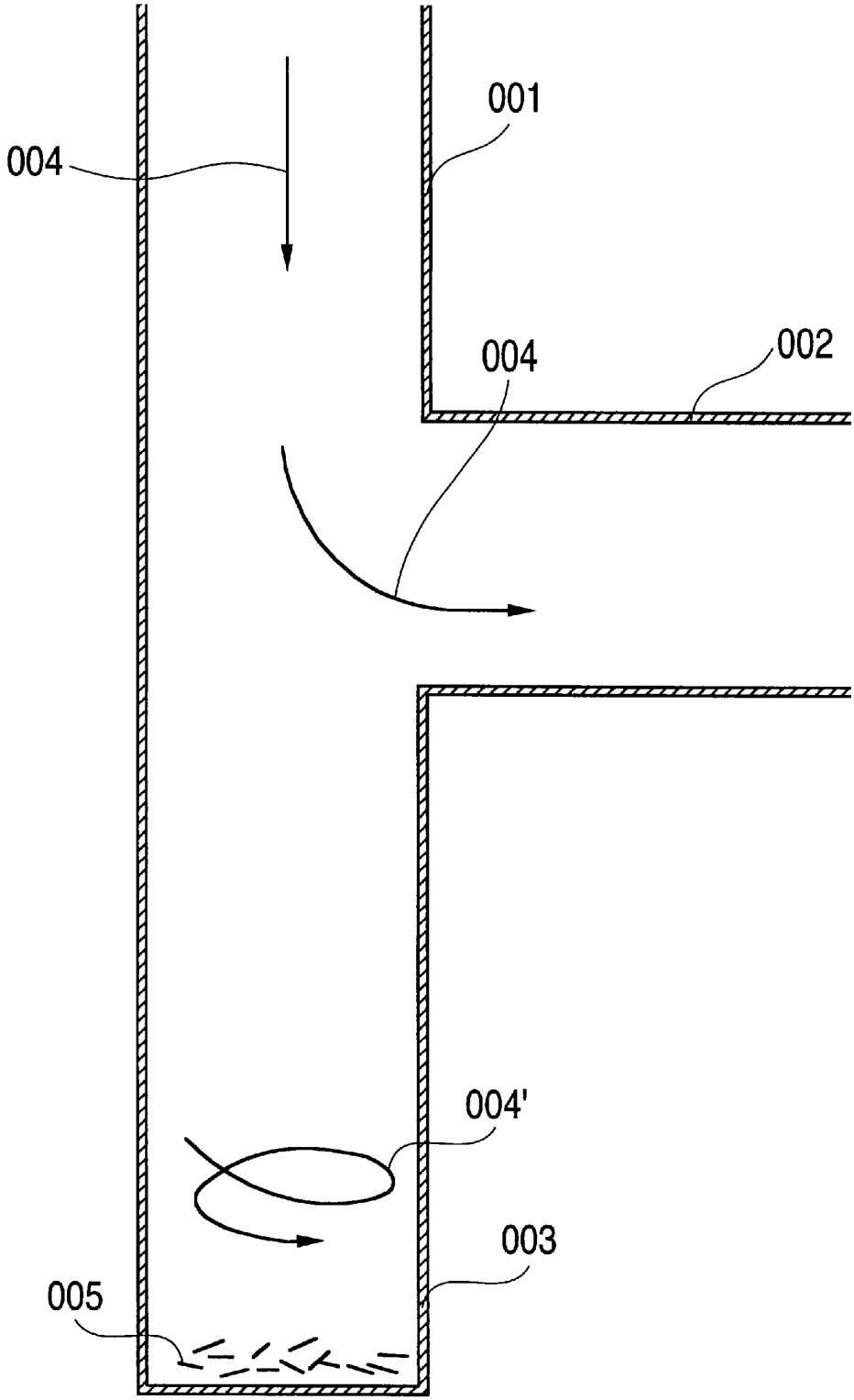
FIG. 12 (PRIOR ART)
FIG. 12 is a longitudinal cross sectional view schematically showing a prior art scale collecting device.

Next, a scale collecting device of a second embodiment will be described with reference to FIGS. 4 and 5. In the present scale collecting device of the second embodiment, while a vertical downward pipe 1, a horizontal branch pipe 2 and a tubular pocket 3 are constructed in the same way as the prior art scale collecting device shown in FIG. 12, there is provided a baffle plate 6 in the tubular pocket 3 in parallel with a tubular axis thereof.

The tubular pocket 3 is formed under the horizontal branch pipe 2 with a depth of about 2.5 times d, where d is an inner diameter of the pipe. The baffle plate 6 is formed in a height of 1.5 times d from a bottom of the tubular pocket 3 and is made by two plates crossing with each other orthogonally as shown in FIG. 5.

According to the scale collecting device of the second embodiment, there is no swirling flow caused around the central axis in the tubular pocket 3 due to the baffle plate 6 provided with two plates in the tubular pocket 3, whereby the scales in the partitioned tubular pocket do not move violently and re-mixing of the scales into the steam main flow is prevented.

Third Embodiment

Next, a scale collecting device of a third embodiment will be described with reference to FIGS. 6 and 7. In the present scale collecting device of the third embodiment, while the scale collecting device of the second embodiment shown in FIGS. 4 and 5 has one turning portion by which the steam main flow is turned quickly to the horizontal flow from the vertical downflow, here there is provided a plurality of quick turning portions.

Figure 6:
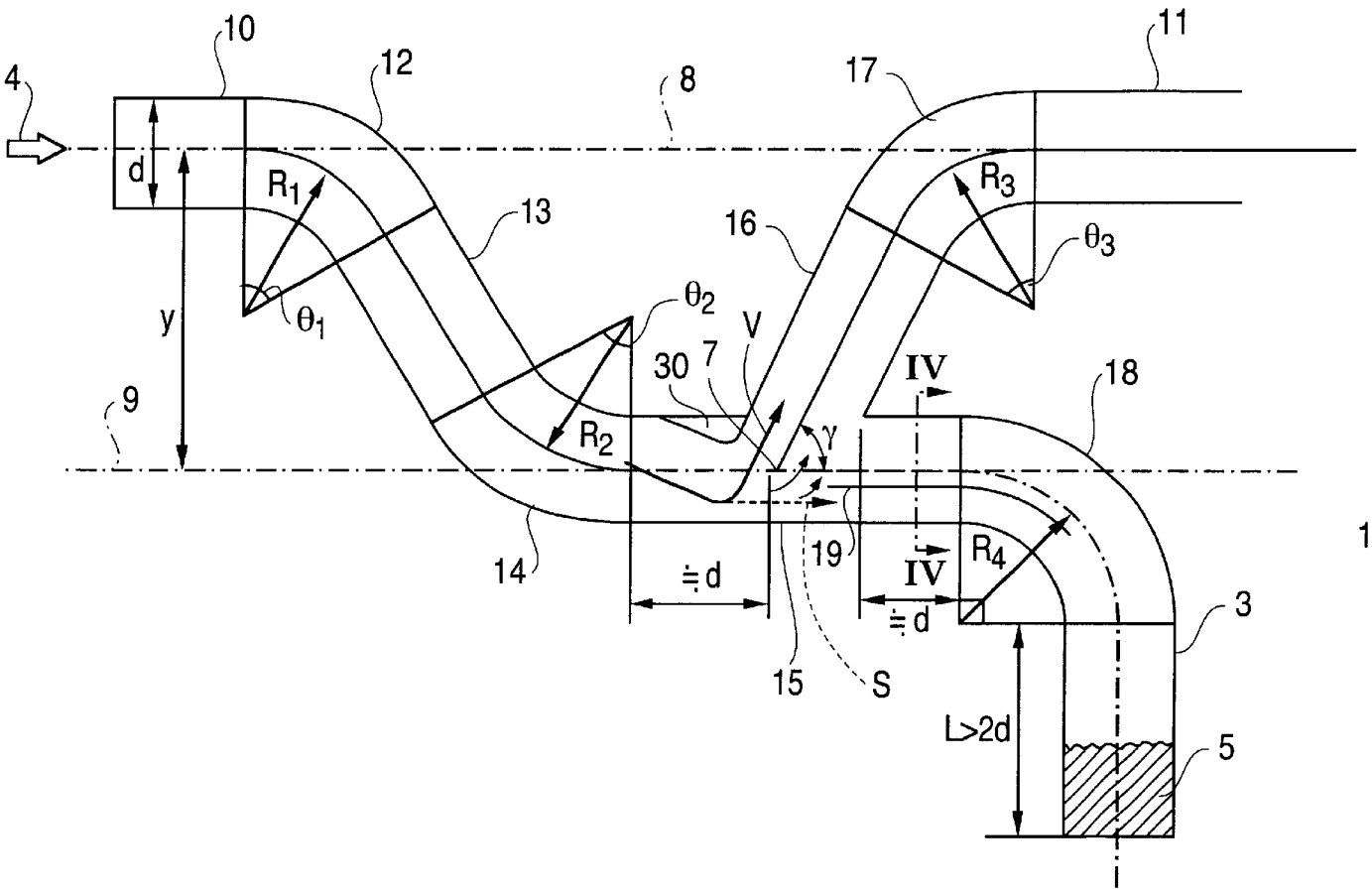
FIG. 6 is a longitudinal cross sectional view of a scale collecting device of a third embodiment according to the present invention.

In FIG. 6, the scale collecting device is disposed between a first horizontal pipe 10 and a second horizontal pipe 11 both on a substantially horizontal first axis 8. Following the first horizontal pipe 10, there are provided sequentially a first bent pipe 12, a downward straight pipe 13, a second bent pipe 14 and a horizontal pipe 15 disposed on a second horizontal axis 9 which is below the horizontal axis 8. The first bent pipe 12 is formed with a curvature radius $R_1$ of about 1.5 times d ($R_1 \approx 1.5$ d), where d is an inner diameter of the pipe, and a bending angle $\theta_1$ of 60° ($\theta_1=60°$). The second bent pipe 14 is formed with a curvature radius $R_2$, which equals $R_1$ ($R_2=R_1$), and a bending angle $\theta_2$, which equals $\theta_1$ ($\theta_2=\theta_1$)

The horizontal pipe 15 has an upward branch pipe 16 which branches with an upward angle $\gamma$ from approximately a mid portion 7 thereof and a third bent pipe 17 which connects the upward branch pipe 16 and the second horizontal pipe 11. The third vent pipe 17 formed likewise with curvature radius $R_3=R_2=R_1$ and $\theta_3=\theta_2=\theta_1$ and vending angle thus the upward angle $\gamma$ equals $\theta_3$ ($\gamma=\theta_3$).

To a terminal end of the horizontal pipe 15, after the branch point 7, is connected a right-angled bent pipe 18 having a curvature radius $R_4$ and a bending angle $\phi$ of 90°, and then a vertically downward tubular pocket 3 is fitted. A partition plate 19 is disposed in the horizontal pipe 15, after the branch point 7, and in the right-angled bent pipe 18, slightly below the second horizontal tubular axis 9. FIG. 7 is a cross sectional view taken on line IV—IV of that part.

In FIG. 6, numeral 30 designates a projection, which is provided in an upper portion of an inner wall of the horizontal pipe 15 immediately before the upward branch pipe 16 so as to project toward a center portion of the horizontal pipe 15. Steam main flow 4 flowing through the downward straight pipe 13 impinges on the projection 30, and then the scales in the steam main flow 4 can be separated efficiently. Steam V is led into the upward branch pipe 16 along a surface of the projection 30 and scales S continue to flow in the horizontal pipe 15 to flow down vertically via the right-angled bent pipe 18 to then be led into the tubular pocket 3, or the steam main flow 4 flowing through the downward straight pipe 13 impinges on the projection 30 and then further impinges on a lower portion of the horizontal pipe 15 to rebound into the upward branch pipe 16, and the scales S continue to flow in the horizontal pipe 15 to flow down vertically via the right-angled bent pipe 18 to then be led into the tubular pocket 3.

It is to be noted that the projection 30 is formed of a hollow member, a solid member, a plate member or the like and may be provided not only in a single piece but also in plural pieces in the flow direction.

According to the present scale collecting device, as explained before with reference to FIGS. 9 and 10, the scales can be efficiently collected in the tubular pocket 3 by the inertia force.

Fourth Embodiment

Next, a scale collecting device of a fourth embodiment will be described with reference to FIG. 8. In the present fourth embodiment, in addition to the tubular pocket of the scale collecting device according to the present invention, there is provided a structure for discharging the collected scales and the like.

Figure 8:
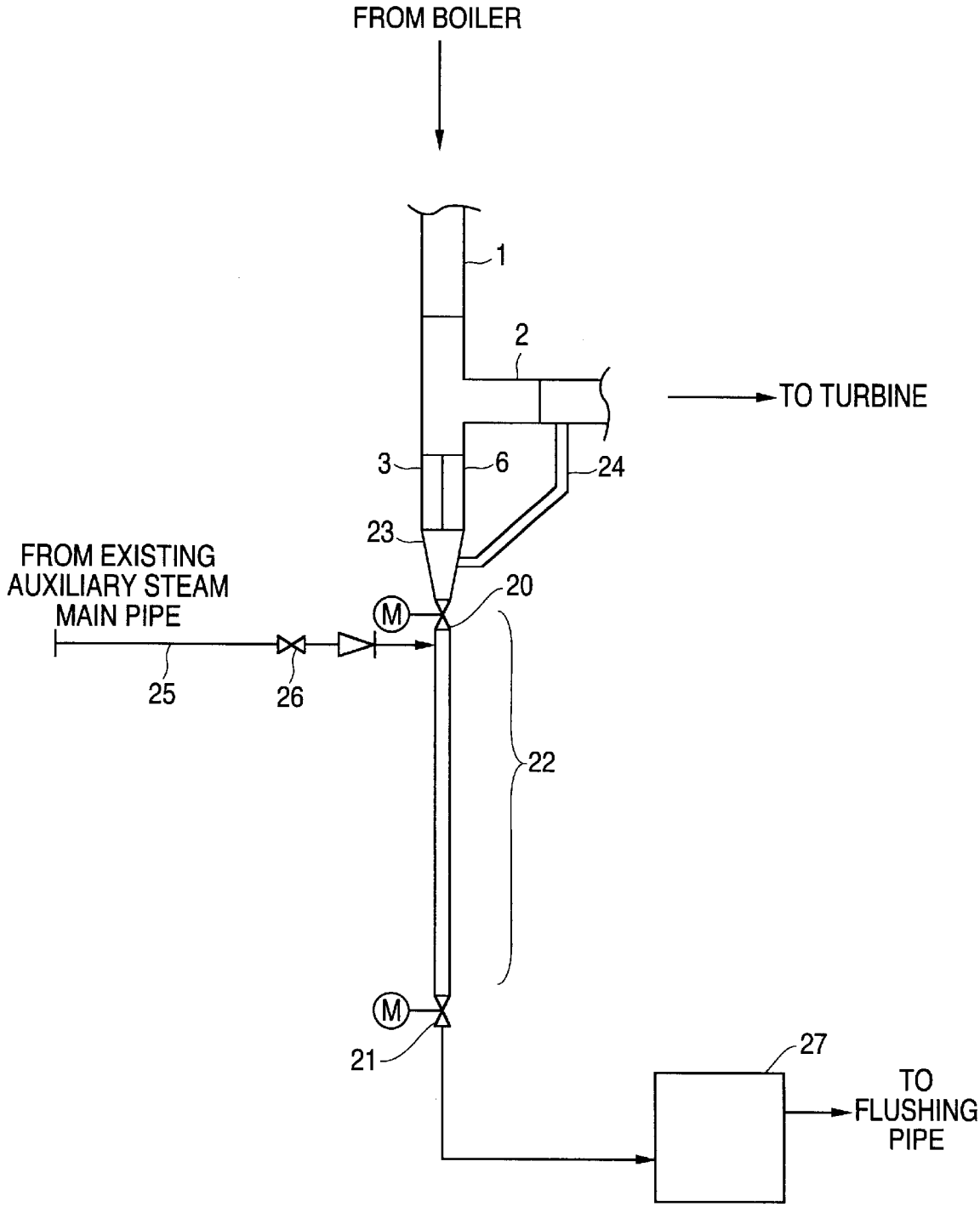
FIG. 8 is a longitudinal cross sectional view of a scale collecting device of a fourth embodiment according to the present invention.
Figure 9:
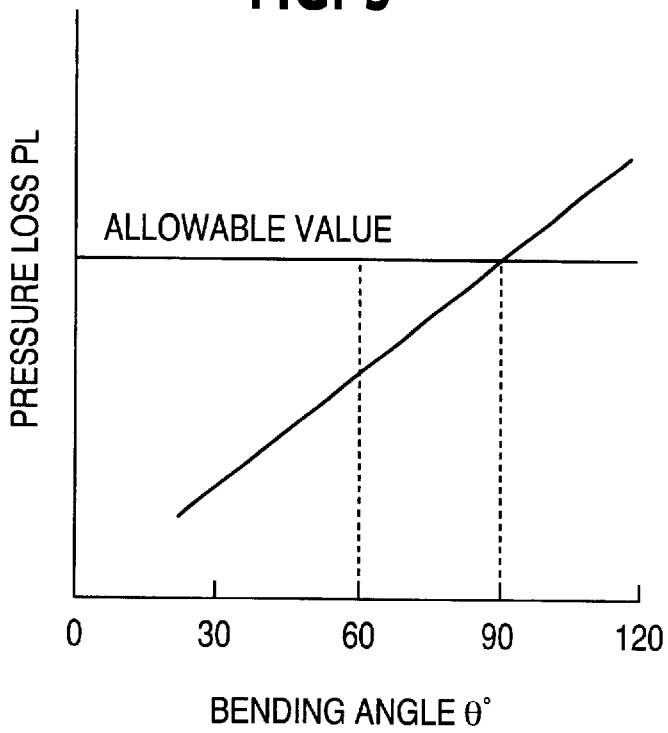
FIG. 9 is a graph showing a relation between a bending angle and a pressure loss of a bent pipe.
Figure 10:
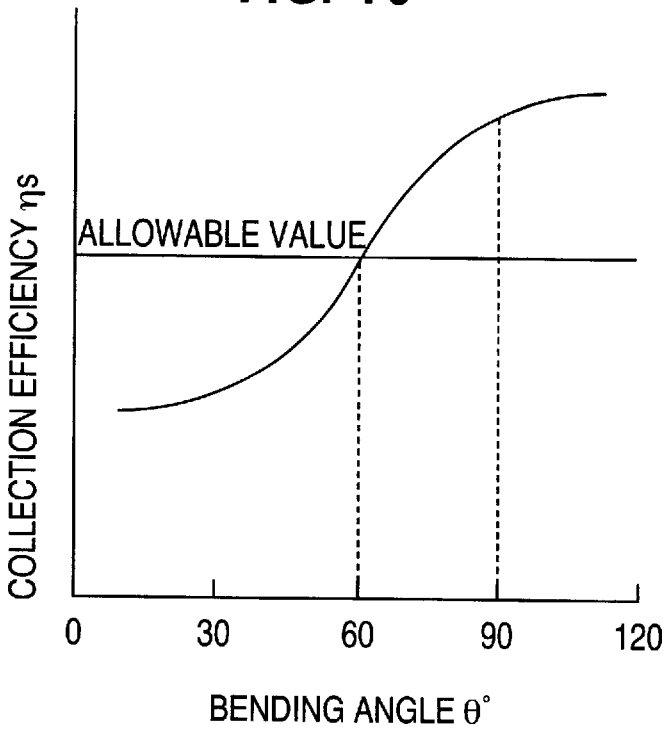
FIG. 10 is a graph showing a relation between the bending angle and a scale collection efficiency of the bent pipe.

In FIG. 8, numeral 20 designates an opening/closing valve of a parallel slide valve or the like. Numeral 21 designates a scale discharge and drain valve and numeral 22 designates a scale accumulating portion, which is disposed between the opening/closing valve 20 and the scale discharge and drain valve 21, and is made by a pipe. For the scale discharge and drain valve 21, which functions both as a drain valve and as a scale discharge valve, a Y-type globe valve, clad with stellite, in which there is no pocket portion for scale gathering and in which the scales are discharged straight when the valve is opened, is preferably employed for prevention of erosion and scale biting.

Numeral 23 designates a connecting portion, which connects a tubular pocket 3 of the scale collecting device and the scale accumulating portion 22. The opening/closing valve 20 is interposed between this connecting portion 23 and the scale accumulating portion 22. A warming line 24 is provided between a horizontal branch pipe 2 and the connecting portion 23. Also, an auxiliary steam pipe 25, which is connected at one end to an auxiliary steam main pipe (not shown), is connected at the other end to an upper portion of the scale accumulating portion 22 via an opening/closing valve 26. The scale discharge and drain valve 21 provided to a lower portion of the scale accumulating portion 22 is connected to a scale collector 27.

While the device of FIG. 8 is constructed as mentioned above, operation of the scale collecting by this device is carried out as follows.

When the plant is being operated, the scale collecting device is operated with the opening/closing valve 20 being opened and the scale discharge and drain valve 21 being closed and the scales in the steam flowing through a vertical downward pipe 1 are collected in the tubular pocket 3 to then be accumulated in the scale accumulating portion 22 via the opening/closing valve 20. Then, the opening/closing valve 20 is closed, the scale discharge and drain valve 21 is opened and the scales accumulated in the scale accumulating portion 22 are collected into the scale collector 27.

At this time, in order to not cause clogging and the like due to the scales, the opening/closing valve 26 is opened and auxiliary steam is led into the scale accumulating portion 22 for purging. Thus, while the scale discharge and drain valve 21 functions as the scale discharge valve, it also functions as the drain valve, wherein the scale discharge and drain valve 21 is opened at the time of start and stop of the unit.

If the unit is one to be operated by DSS (daily start and stop), the scale discharge and drain valve 21 is opened and closed every day so that the scales are discharged every day, but if the unit is not such as operated by DSS, the scale discharge is done every three days or so.

The operation procedures of the scale discharge in the device of the fourth embodiment shown in FIG. 8 are summarized as follows:

1) The opening/closing valve 20 is closed so that the scale discharge device is separated from the system.
2) The scale discharge and drain valve 21 is opened and the scales accumulated in the scale accumulating portion 22 are discharged by the inner pressure.
3) The opening/closing valve 26 is opened and the scales remaining in the scale accumulating portion 22 are discharged by the auxiliary steam.
4) After the scales have been discharged, the auxiliary steam flows continuously for several minutes more so that the scales not remain in pocket portions or the like and so that air that has flowed into the scale discharge device may be discharged.
5) The scale discharge and drain valve 21 is closed so that the inner pressure may be maintained in the scale accumulating portion 22.
6) The opening/closing valve 26 is closed and supply of the auxiliary steam is stopped.
7) The opening/closing valve 20 is opened so that the scale discharge device is returned to the system.

By the procedure mentioned above, the scales may be discharged while the unit is being operated. The scale discharge is done every three days or so at the initial stage, and thereafter the interval thereof is elongated gradually according to the quantity of scales to be collected.

Fifth Embodiment

Figure 4:
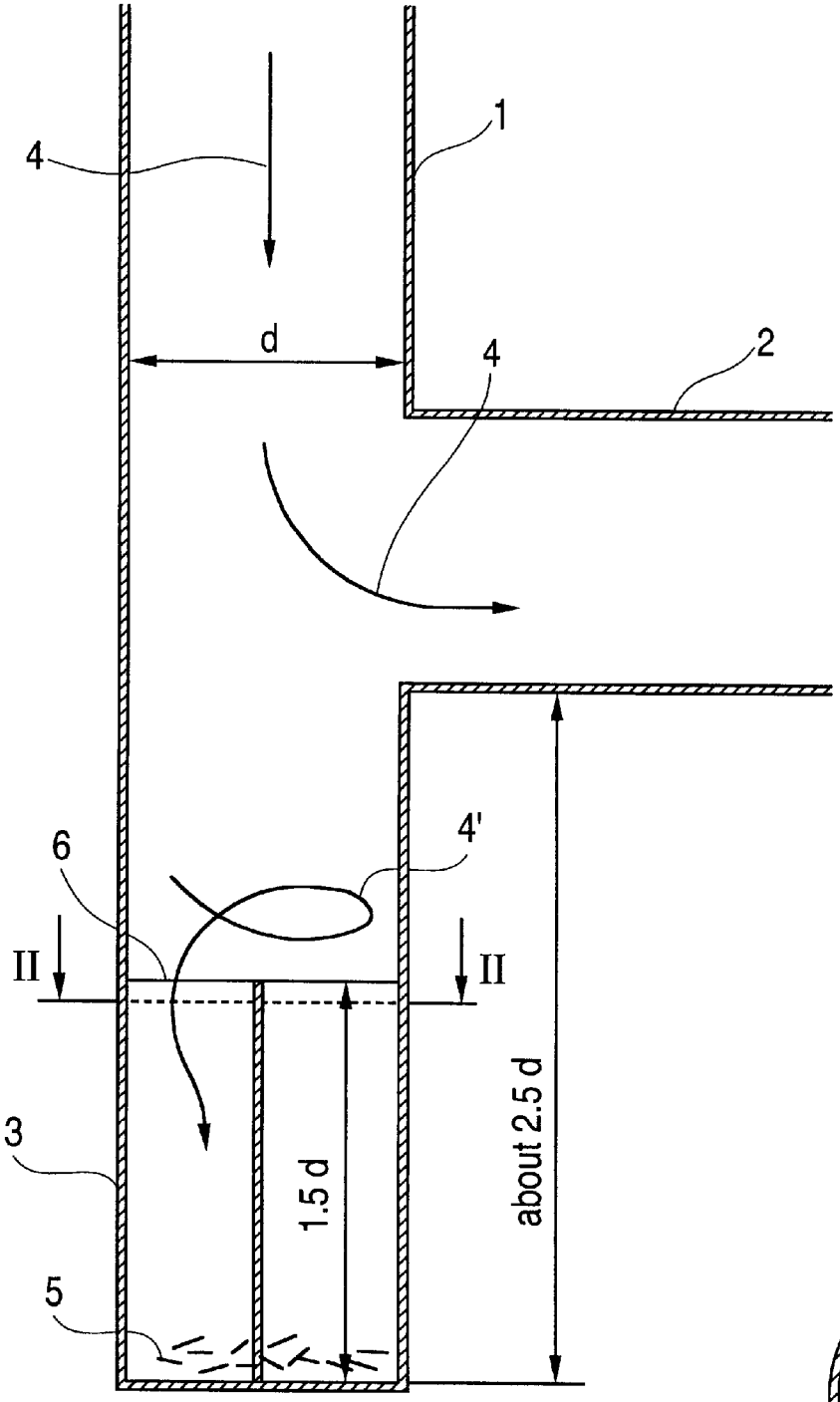
FIG. 4 is a longitudinal cross sectional view of a scale collecting device of a second embodiment according to the present invention.
Figure 5:
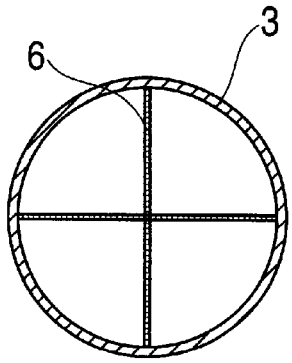
FIG. 5 is a cross sectional view taken on line II—II of FIG. 4.
Figure 7:
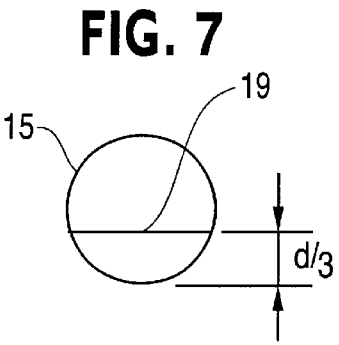
FIG. 7 is a cross sectional view taken on line IV—IV of FIG. 6.
Figure 11:
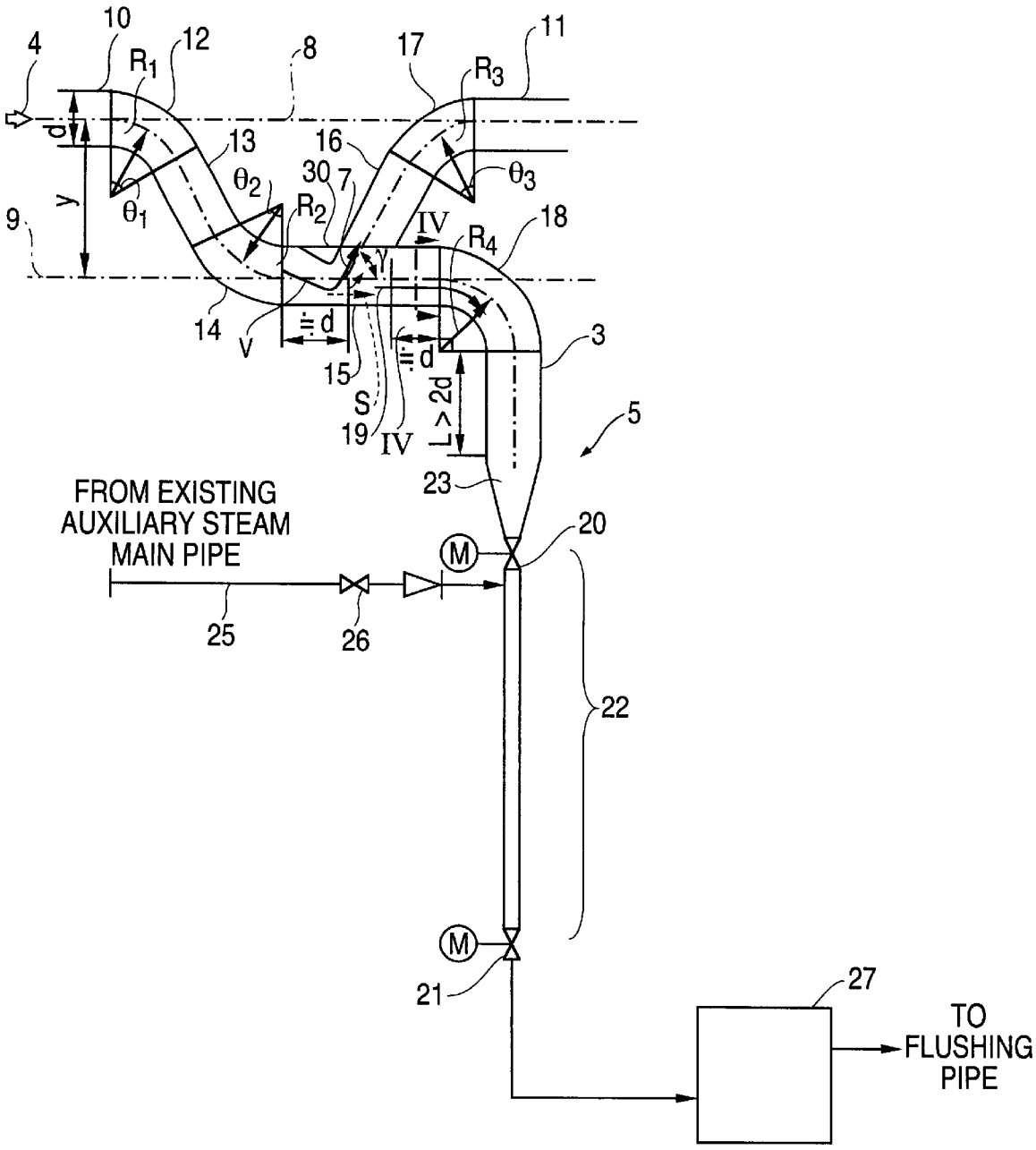
FIG. 11 is a longitudinal cross sectional view of a scale collecting device of a fifth embodiment according to the present invention.

While the fourth embodiment shown in FIG. 8 is made such that the structure to discharge the collected scales and the like is added to the tubular pocket 3 of the scale collecting device of the second embodiment shown in FIGS. 4 and 5, a similar discharge structure is added to the tubular pocket 3 of the scale collecting device of the third embodiment shown in FIGS. 6 and 7, which is shown in FIG. 11 as a fifth embodiment.

As shown in FIG. 11, a scale accumulating portion 22 has at its proximal end an opening/closing valve 20 and at its distal end a scale discharge and drain valve 21 and is connected to the scale collecting device of the third embodiment shown in FIGS. 6 and 7 via a connecting portion 23. The scale accumulating portion 22 is connected to a scale collector 27.

In FIG. 11, similar parts to those described before are given the same reference numerals and description thereon will be omitted.

Thus, in the scale collecting device of the present fifth embodiment, the collected scales are gathered in the scale accumulating portion 22 and the opening/closing valve 20 of the proximal end and the scale discharge and drain valve 21 of the distal end are operated. The scales accumulated in the scale accumulating portion 22 can thereby be collected into the scale collector 27 without the operation of the unit being stopped.

It is to be noted that as the scale collecting device is provided in the main steam pipe, so as to be at a supercritical pressure in ordinary operation, there is no need to worry about a drain generation. But as the scale accumulating portion 22 is basically a dead zone, where there is little flow, there occurs a temperature distribution due to heat dissipation. In order to reduce this differential temperature as much as possible, there is provided a warming line 24 as shown in FIG. 8. At the time of start and stop of the unit, the scale discharge and drain valve 21 is operated in the same manner as an ordinary drain valve so that drain in the main steam pipe may be discharged.

While the invention has been described concretely based on the embodiments illustrated, the invention is not limited thereto but may be provided with various modifications in the concrete structure and construction thereof as come within the scope of the appended claims.

For example, in the fourth embodiment shown in FIG. 8 and in the fifth embodiment shown in FIG. 11, the auxiliary steam from the auxiliary steam main pipe is used for discharging the remaining scales in the scale accumulating portion 22, but auxiliary air may be used in place thereof.

As a summary of the effect of the present invention, in the steam pipe extending from the power generation boiler to the power generation steam turbine, there is provided a direction turning portion where the vertical portion and the lateral portion communicate with each other in a T-shape, and the scale collecting portion is provided in -the elongated portion of the vertical portion below the direction turning portion. The T-shape direction turning portion is formed in an integral unit of forged steel, whereby the effects of collecting the boiler scale particulates without a problem of high pressure steam flow and having an excellent sealing ability and high safety can be obtained.

Also, the elongated portion of the vertical steam pipe is formed with a length of about four times or more of the inner diameter of the steam pipe. Thus for a certain time period, regardless of the quantity and particle sizes of the flowing boiler scale particulates, there occurs no problem of the boiler scale particulates collected in the elongated portion scattering or being entrained into the lateral steam pipe via the direction turning portion. Thus not only are the boiler scale particulates are prevented from entering the steam turbine, but no problem of the direction turning portion and the elongated portion being eroded by the scale particulates occurs.

Also, the boiler scale collecting portion may be formed in plural stages, whereby the collection efficiency can be enhanced. Also, the forged T-shape direction turning portion may be connected with a steel steam pipe by welding to form integral unit and the forged elongated portion connected at its lower end with the steel hopper by welding to form the integral unit, whereby a boiler scale collecting device of high safety which can last sufficiently for the steam boiler periodic inspection period of a predetermined time interval can be obtained.

Also, in the present scale collecting device, there is provided the baffle plate in the tubular pocket formed in the elongated portion beyond the horizontal branch portion of the vertical downward pipe. The swirling flow in the pocket is thus prevented and the scales can be separated into the pocket efficiently.

Also, in the other scale collecting devices of the present invention, the first to fourth bent pipes of the specific forms and the upward branch pipe and the like are provided, whereby the scales in the steam can be efficiently separated into the tubular pocket by the inertia force.

Thus, in the scale collecting device for collecting the scales mixed in the steam main flow with the bent passage or branch/turn passage, the objects of enhancing the scale collection efficiency and reducing the pressure loss have been confirmed by the present invention to stand together.

What is claimed is:

1. A boiler scale collecting device before a steam turbine constructed such that steam main flow flowing in a steam piping for leading steam from a boiler to a turbine is caused to pass through a bent passage or a branch/turn passage so that scales mixed in the steam may be separated, wherein said steam piping is formed so that said steam main flow turns quickly at a horizontal branch portion where a vertical downward pipe is turned to a horizontal branch pipe, said vertical downward pipe is elongated beyond said horizontal branch portion to form a tubular pocket and a baffle plate is provided in said tubular pocket in parallel with a tubular axis thereof.

2. A boiler scale collecting device before a steam turbine constructed such that steam main flow flowing in a steam piping for leading steam from a boiler to a turbine is caused to pass through a bent passage or a branch/turn passage so that scales mixed in the steam may be separated, wherein there are provided in a mid portion of a substantially horizontally disposed steam piping a first bent pipe of a curvature radius $R_1$ and a bending angle $\theta_1$, a downward straight pipe extending from said first bent pipe, a second bent pipe of a curvature radius $R_2$ and a bending angle $\theta_2$ extending from said downward straight pipe and a horizontal pipe extending from said second bent pipe and disposed below said substantially horizontally disposed steam piping; said horizontal pipe has an upward branch pipe of an upward angle $\gamma$ and a straight pipe portion; said upward branch pipe connects to said substantially horizontally disposed steam piping via a third bent pipe of a curvature radius $R_3$ and a bending angle $\theta_3$; said straight pipe portion connects to a fourth bent pipe of a curvature radius $R_4$ and a bending angle of 90°; and said fourth bent pipe is elongated downward vertically to form a tubular pocket; and where an inner diameter of said steam piping is d, said curvature radii $R_1$, $R_2$, $R_3$ and $R_4$, respectively, are larger than 1.5d and smaller than 2.5d ($1.5d<R_1, R_2, R_3, R_4<2.5d$), said bending angles $\theta_1$, $\theta_2$ and $\theta_3$, respectively, are larger than 60° and smaller than 90° ($60°<\theta_1, \theta_2, \theta_3<90°$) and said $\gamma$ equals 60° ($\gamma=60°$).

3. A boiler scale collecting device before a steam turbine as claimed in claim 2, wherein there is provided in an upper portion of an inner wall of said horizontal pipe immediately before said upward branch pipe a projection projecting from a top portion of said horizontal pipe toward a central portion thereof.

4. A boiler scale collecting device before a steam turbine as claimed in claim 2, wherein there is provided a partition plate in a pipe passage extending from a downstream side of a branch portion of said upward branch pipe to a mid portion of said fourth bent pipe.

5. A boiler scale collecting device before a steam turbine as claimed in claim 2, wherein said tubular pocket elongated downward from said fourth bent pipe constitutes a scale accumulating portion and said scale accumulating portion is connected to a scale collector as well as is provided at its proximal end and distal end with opening/closing valves, respectively.

6. A boiler scale collecting device for collecting scales from a steam main flow flowing in steam piping before a steam turbine, comprising:

steam piping forming a bent passage or branch/turn passage to pass therethrough the steam main flow so that scales mixed in the steam may be separated, including a vertical downward pipe that is turned to a horizontal branch pipe;

a tubular pocket formed by said vertical downward pipe being elongated beyond said horizontal branch pipe;

a scale accumulating portion connected to said tubular pocket and having opening/closing valves at proximal and distal ends thereof;

a scale collector connected to said scale accumulating portion; and an auxiliary steam pipe connected to an upper portion of said scale accumulating portion by an opening/closing valve.

7. A boiler scale collecting device for collecting scales from a steam main flow flowing in steam piping before a steam turbine, comprising:

steam piping forming a bent passage or branch/turn passage to pass therethrough the steam main flow so that scales mixed in the steam may be separated, including a vertical downward pipe that is turned to a horizontal branch pipe;

a pocket formed by said vertical downward pipe being elongated beyond said horizontal branch pipe;

a scale accumulating portion connected to said pocket;

a first opening/closing valve at a proximal end of said scale accumulating portion between said scale accumulating portion and said pocket; and a second opening/closing valve at a distal end of said scale accumulating portion.

8. The device of claim 7, and further comprising:

a scale collector connected to said distal end of said scale accumulating portion.

9. The device of claim 7, and further comprising:

an auxiliary pipe connected to said proximal end of said scale accumulating portion by an opening/closing valve.

* * * * *